United States Patent [19]

Campolito

[11] Patent Number: 4,466,219

[45] Date of Patent: Aug. 21, 1984

[54] ADJUSTABLE MANHOLE COVER

[76] Inventor: James J. Campolito, 3203 White Beach La., Youngstown, Ohio 44511

[21] Appl. No.: 495,652

[22] Filed: May 18, 1983

Related U.S. Application Data

[63] Continuation-in-part of Ser. No. 336,874, Jan. 4, 1982.

[51] Int. Cl.[3] ..... E02D 29/14

[52] U.S. Cl. ..... 52/20; 404/25; 404/26

[58] Field of Search ..... 52/19, 20, 21, 200; 404/25, 26; 210/163, 164

[56] References Cited

U.S. PATENT DOCUMENTS

| | | | |
|---|---|---|---|
| 1,908,909 | 5/1933 | Manz | 52/19 |
| 2,082,269 | 6/1937 | Walker | 52/19 |
| 3,217,619 | 11/1965 | Driver et al. | 404/25 |
| 3,218,943 | 11/1965 | Bowman | 404/26 |
| 3,408,778 | 11/1968 | Mason | 404/26 |
| 3,891,337 | 6/1975 | McCoy | 404/26 |
| 4,038,789 | 8/1977 | Axgarde et al. | 52/20 |
| 4,097,171 | 6/1978 | Fier | 404/25 |
| 4,225,266 | 9/1980 | Fier | 404/25 |
| 4,302,126 | 11/1981 | Fier | 52/19 |
| 4,348,281 | 9/1982 | Perry et al. | 210/163 |

FOREIGN PATENT DOCUMENTS

| | | | |
|---|---|---|---|
| 730570 | 12/1942 | Fed. Rep. of Germany | 52/19 |
| 2059124 | 11/1970 | Fed. Rep. of Germany | 404/26 |
| 1538172 | 7/1968 | France | 404/26 |
| 624444 | 7/1981 | Switzerland | 52/20 |

*Primary Examiner*—John E. Murtagh
*Assistant Examiner*—Andrew J. Rudy
*Attorney, Agent, or Firm*—Harpman & Harpman

[57] ABSTRACT

Manhole cover support rings and clips are used to increase the height of an existing manhole cover support frame for raising the height of a manhole cover positioned thereon so as to match or be level with a resurfaced roadway. The support rings are split so as to be adjustable with respect to the diameter are position by clips on the existing manhole cover support frame and are secured thereto by clips to form the elevated support for the manhole cover.

3 Claims, 5 Drawing Figures

ADJUSTABLE MANHOLE COVER

This is a continuation in part of patent application Ser. No. 06/336,874, filed Jan. 4, 1982.

BACKGROUND OF THE INVENTION

1. Field of the Invention

This invention relates to mahole cover support and devices for increasing the height of the same to compensate for increased roadway height when resurfacing occurs.

2. Description of the Prior Art

Prior art devices have disclosed a number of different ways in which manhole covers can be raised by insertion of a variety of devices.

See for example U.S. Pat. Nos. 3,218,943, 3,891,337, 4,097,171 and 4,225,266.

A manhole cover support is disclosed in U.S. Pat. No. 3,218,943 having a plurality of vertically spaced circumferentially continuous teeth in a ring which is designed to selectively engage individual teeth which extend from a second part of the manhole cover. The arrangement allows the second part to support the manhole cover in adjusted vertical position at the time of insulation so as to match roadway surfacing material to be laid thereabout.

U.S. Pat. No. 3,891,337 discloses a one-piece split ring that has a single adjustment and locking bolt engaged in threaded openings in lugs positioned adjacent the ends of the split ring. The ring supports the manhole cover in elevated relation to its original position on a manhole cover support frame.

U.S. Pat. No. 4,097,171 shows a similar ring configuration with a two-piece toggle mechanism which when engaged in an over center position forces the ring outwardly locking the same in the manhole cover support frame.

Finally in U.S. Pat. No. 4,225,266, a method and apparatus is disclosed for raising manhole covers by a flanged split ring secured within the manhole cover support frame by an adjustable link, which after adjustment is hammered in place spreading the ring and locking the same in the manhole cover support frame.

Manholes are normally located in roadways or streets to allow access to underground sanitary and storm sewers and utility conduits. These manholes consist of an inverted belt-shaped metal frame supported by a brick or concrete base structure. The metal frame has an internal annular ledge for supporting a manhole cover which is lever with the top of the frame and the surrounding roadway surface. When resurfacing roadways, a layer of pavement is placed on the existing pavement resulting in the manhole cover being below the top surface of the new pavement causing a depression in the roadway. The common practice has been to elevate the manhole frame by removing the existing pavement around the manhole and increasing the support material with brick or concrete beneath the manhole frame and reasserting the frame on top of the supports. The raised frame is then repositioned and the roadway area abutting the manhole is replaced.

Applicant's invention uses a pair of split rings and clamps which are positioned on top of an existing manhole metal frame so as to increase the effective height of the same and particularly the internal annular ledge which supports the manhole cover. Combinations of split rings and clamps of applicant's invention provide a variety of height adjustment with the arrangement of the split rings forming a desirable annular configuration for receiving and holding the manhole cover at the desired increased height. The multiple rings are adjustable secured to the existing manhole metal frame and the roadway. The procedure can be performed in a short time at low cost and eliminates the problems heretofore associated with raising of the metal frames and the manhole cover supports thereby.

SUMMARY OF THE INVENTION

An adjustable manhole cover support ring system provides two split rings with clips and spacers, which upon being positioned on the internal annular ledge of the manhole metal frame provides a new and desirable elevated structure matching the configuration of the manhole metal frame and the internal annular ledge thereof so that a manhole cover when placed thereon is positioned at the desired vertical height to bring the cover level with the resurfaced roadway.

DESCRIPTION OF THE PREFERRED EMBODIMENT

Figure 1:
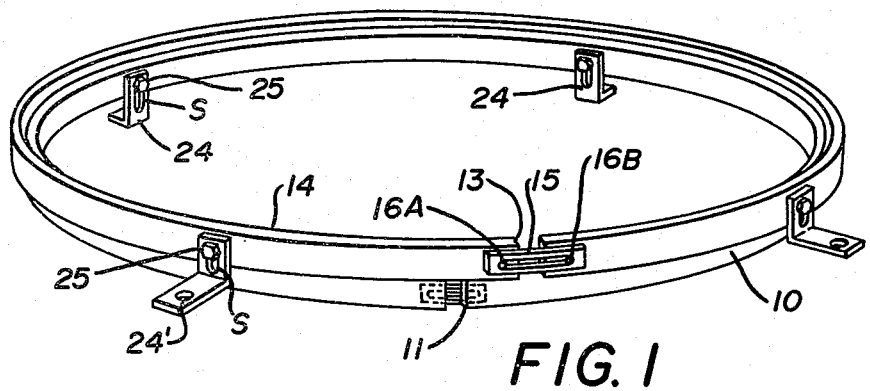
FIG. 1 is a perspective view of a pair of manhole cover support rings and clips.
Figure 2:
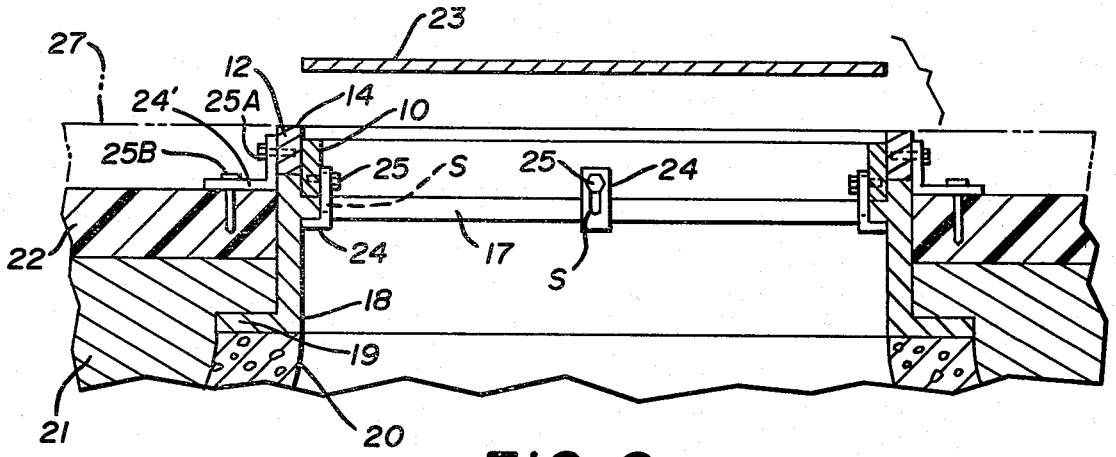
FIG. 2 is a cross section of a typical manhole with the manhole cover support rings and clips positioned on the metal frame thereof.

A manhole cover support ring assembly is shown in FIGS. 1 and 2 of the drawings as comprising a primary ring 10 which is split at 11. The ring 10 is made from an inexpensive flattened steel bar rolled into a circle with a predetermined gap between its ends. The diameter of the ring 10 may therefore be easily changed to match a particular manhole metal frame. A secondary ring 12, which is split at 13, is formed in a similar manner from a flattened steel bar having a transversely flat upper surface 14. The diameter of the secondary ring 12 can be readily varied to match the outer diameter of the primary ring 10 when the secondary ring 12 is positioned around the upper outer surface of the primary ring 10 and secured in the desired diameter by a clamp 15 adjustably attached to the ends of the split rings. The clamp 15 is rectangular with an elongated slot S within. A pair of fasteners 16A and 16B extend through the slot S and into threaded openings positioned inwardly of the split 11 and 13 in the rings 10 and 12 so as to form the manhole cover support ring assembly illustrated in FIG. 1 of the drawings.

By referring now to FIG. 2 of the drawings, it will be seen that the manhole cover support ring assembly just described is illustrated as being positioned on an internal annular ledge 17 of a manhole metal frame 18 which has an outturned annular flange 19 resting on the base structure 20 of the manhole. The area around the base structure 20 and the manhole metal frame 18 is usually filled with earth and/or compacted base material 21 which supports the roadway material 22.

Still referring to FIG. 2 of the drawings, it will be seen that a manhole cover 23 is shown in exploded relation to the manhole metal frame 18 and that it is of a diameter that matches the inner diameter of the manhole metal frame 18 above the internal annular ledge 17 where it was originally positioned.

In FIG. 2 of the drawings, the primary ring 10 is shown in position on the internal annular ledge 17 of the manhole frame and is adjustably secured thereto by a slotted clip 24 and a fastener 25 positioned therethrough.

Figure 3:
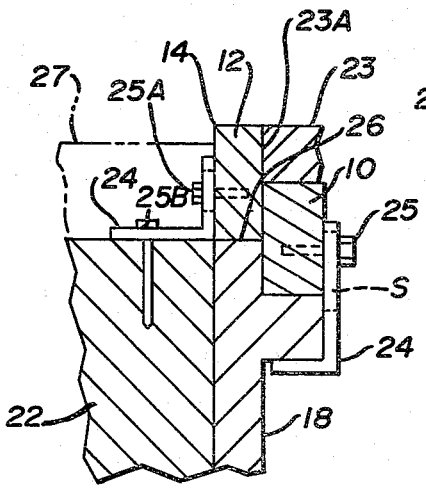
FIG. 3 is an enlarged cross section of a portion of the manhole metal frame in the manhole cover support rings shown in FIG. 1.
Figure 4:
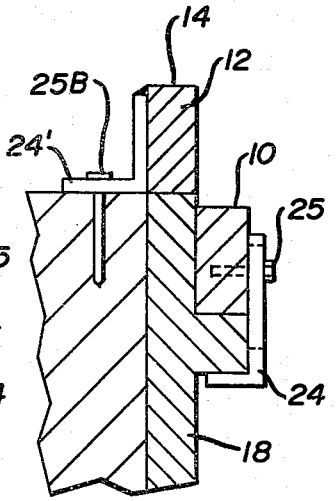
FIG. 4 is a cross section of an alternate arrangement of attachment of the manhole cover support rings to the manhole's metal frame.

The clip 24 is thus adjustably secured to the primary ring 10 by the fasteners 25. The secondary ring 12 is illustrated in FIGS. 2 and 3 of the drawings as being positioned on an upper annular edge 26 of the manhole metal frame 18 in circumferential engagement with the outer upper annular surface of the primary ring 10 and secured in position thereon by slotted clips 24' adjustably secured by fasteners 24B to the outer surface of the ring 12 and permanently secured to the roadway by fasteners 25B. The arrangement is such that the supporting ring assembly comprising the primary ring 10 and the secondary ring 12 recreates the configuration necessary for the reception and retention of the manhole cover 23 with its edge 23A registering with the secondary ring 12.

By referring again to FIG. 2 of the drawings, the broken lines 27 will be seen to illustrate the location of the resurfacing material to be laid on the roadway and it will be seen that the upper surface of the resurfacing material is level with the upper surface 14 of the secondary ring 12 and the upper surface of the manhole cover 23.

It will occur to those interested in the invention that the rings can be used with multiple elongated annular spacers 28, which are of different heights, and will conform to the different height manhole configurations now in use.

Figure 5:
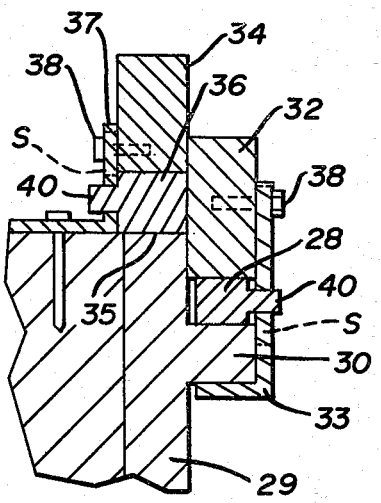
FIG. 5 is a cross section of an alternate arrangement of support rings, clips and spacers positioned within the manhole support frame.

Referring now to FIG. 5 of the drawings, an example of this use may be seen in which a manhole metal frame 29 is provided with an internal annular flange 30 having an upper annular edge 31. A primary split ring 32 is positioned on the ledge 31 and held by L-shaped clips 33 thereto and a secondary split ring 34 is positioned on an upper edge 35 of the manhole metal flange 29 having a plurality elongated annular of spacers 36 positioned thereon. A number of the clips 37 are secured to the secondary split ring 34 and by fasteners 38. Each of the clips 33 and 37 have a rectangular slot S in one portion through which the fasteners 38 pass allowing for vertical adjustment of the clips 33 and 37 in relation to the rings. Each of the spacers 28 and 36 have a tab 40 that engages the rectangular slot S in the clips so as to position and hold the same adjacent each clip. The spacers are of different heights allowing for a variety of vertical adjustments which is required to match the variable height requirements found in the field.

It will be seen that a manhole cover, which originally rests on the internal annular ledge 30, can now be positioned in elevated relation thereto on the split ring 34 with the edge of the cover registering with the edge of the split ring 34.

It will occur to those skilled in the art that the height of each of the primary and secondary split rings of the support ring assembly is disclosed herein can be varied by using spacers and clips so that any desired height elevation of assembly can be obtained to desirably position the manhole cover above the original location thereof.

The above-described structure provides relatively easy and fast height adjustment of manhole metal frames as supporting ring assemblies can be readily sized to the particular diameter of a manhole frame on which they are to be installed so as to register properly therewith and so as to properly support the manhole cover regardless of its actual diameter and thickness. The structure is thus versatile and solves several of the problems that existed in connection with resurfacing roadways and the like.

Although but two embodiments of the present invention have been illustrated and described, it will be apparent to those skilled in the art that various changes and modifications may be made therein without departing from the spirit of the invention and having thus described my invention what I claim is:

1. An adjustable manhole cover support ring assembly for adjusting the elevation of a manhole cover with respect to a manhole frame in a roadway having an inner annular ledge and an upper annular edge thereabout and comprising at least a pair of split rings, a first one of which is arranged to be positioned on said inner annular ledge and a second one of which is arranged to be positioned on said upper annular edge and around said first ring so as to define an area on said first ring and within said second ring for the reception of said manhole cover, adjustable means for securing said rings to said manhole frame consisting of a plurality of L-shaped clips, each having an elongated slot in one portion thereof and fasteners in said slots engaging said annular rings.

2. An adjustable manhole cover support ring assembly for adjusting the elevation of a manhole cover with respect to a manhole frame in a roadway having an inner annular ledge and an upper annular edge thereabout and comprising at least a pair of split rings, a first one of which is arranged to be positioned on said inner annular ledge and a second one of which is arranged to be positioned on said upper annular edge and around said first ring so as to define an area on said first ring and within said second ring for the reception of said manhole cover, adjustable means for securing said rings to said manhole frame consisting of a plurality of L-shaped clips, each having an elongated slot in one portion thereof and fasteners in said slots engaging said annular rings and wherein a plurality of spacers are positioned under said rings adjacent said clips.

3. An adjustable manhole cover support ring assembly for adjusting the elevation of a manhole cover with respect to a manhole frame in a roadway having an inner annular ledge and an upper annular edge thereabout and comprising at least a pair of split rings, a first one of which is arranged to be positioned on said inner annular ledge and a second one on which is arranged to be positioned on said upper annular edge and around said first ring so as to define an area on said first ring and within said second ring for the reception of said manhole cover, adjustable means for securing said rings to said manhole frame consisting of a plurality of L-shaped clips, each having an elongated slot in one portion thereof and fasteners in said slots engaging said annular rings and wherein a plurality of spacers positioned under said rings adjacent said clips and wherein tabs on said spacers extend outwardly therefrom for engagement in said elongated openings in said L-shaped clips.

* * * * *